United States Patent [19]

Dickens et al.

[11] 4,094,110

[45] June 13, 1978

[54] BUILDING SYSTEM AND METHOD

[75] Inventors: Luther I. Dickens, Radford, Va.; William C. Nanny, San Francisco, Calif.

[73] Assignee: Radva Plastics Corporation, Radford, Va.

[21] Appl. No.: 670,057

[22] Filed: Mar. 24, 1976

[51] Int. Cl.[2] ..... E04B 1/32

[52] U.S. Cl. ..... 52/80; 52/86; 52/88; 52/417; 52/454; 52/444; 52/747

[58] Field of Search ..... 52/80, 81, 86, 88, 612, 52/577, 576, 747, 417, 454, 444, 457; 264/32, 34, 35

[56] References Cited

U.S. PATENT DOCUMENTS

| | | | |
|---|---|---|---|
| 1,397,301 | 11/1921 | Solan | 52/577 |
| 1,875,131 | 8/1932 | Pentland | 52/577 |
| 2,104,869 | 1/1938 | Levy | 52/454 |
| 3,277,219 | 10/1966 | Turner | 52/2 |
| 3,296,755 | 1/1967 | Chisholm | 52/81 |
| 3,597,890 | 8/1971 | Hala | 52/577 |
| 3,676,973 | 7/1972 | Kellert | 52/744 |
| 3,763,608 | 10/1973 | Chamlee | 52/80 |
| 3,918,233 | 11/1975 | Simpson | 52/81 |
| 3,932,973 | 1/1976 | Moore | 52/577 |

FOREIGN PATENT DOCUMENTS

| | | | |
|---|---|---|---|
| 230,326 | 4/1959 | Australia | 52/80 |
| 899,373 | 5/1945 | France | 52/80 |

*Primary Examiner*—Ernest R. Purser
*Assistant Examiner*—Henry Raduazo
*Attorney, Agent, or Firm*—Alvin E. Hendricson

[57] ABSTRACT

A system of constructing buildings by connecting together expanded plastic panels with reinforcing strips bonded thereto and wire mesh attached to the exterior surfaces thereof upon a foundation with at least a portion of the panels having a curved configuration to maximize structural strength of the combination of panels. Concrete is applied to the exterior of the combined panels with the wire mesh then forming reinforcing in the resultant concrete wall upon the panels and the interior is coated with plaster to form a low cost structure with very good insulating properties.

5 Claims, 21 Drawing Figures

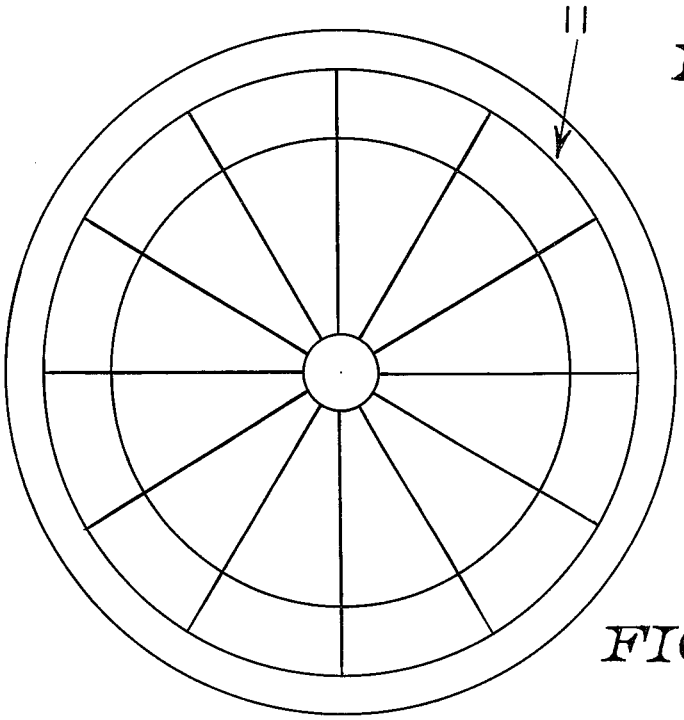
FIG. 1
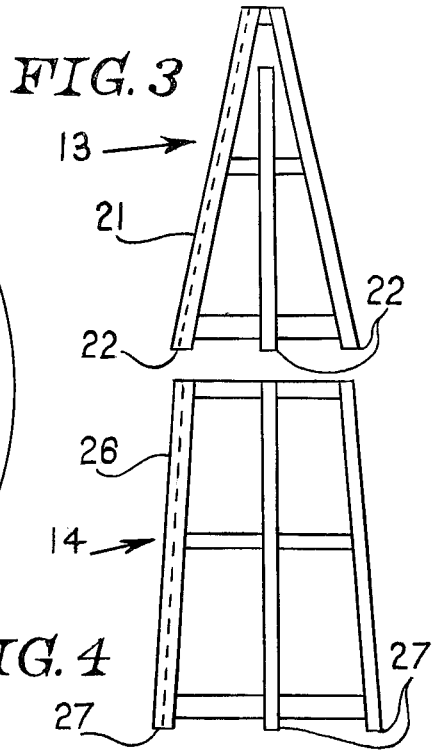
FIG. 3
FIG. 4
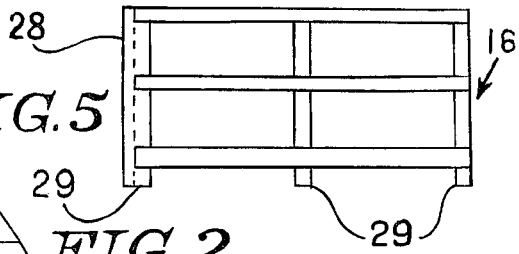
FIG. 5
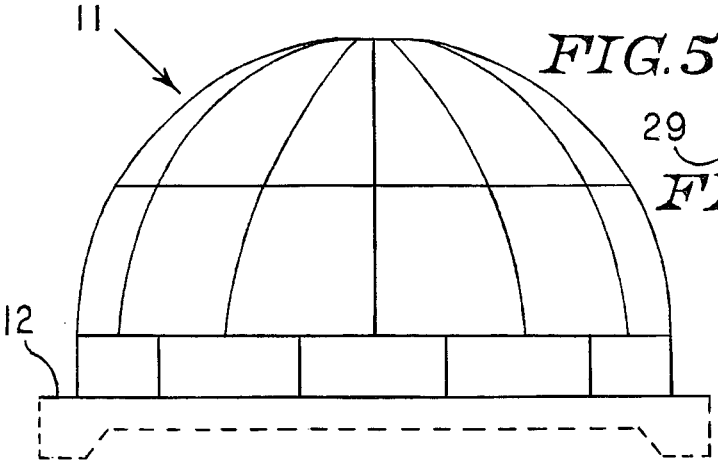
FIG. 2
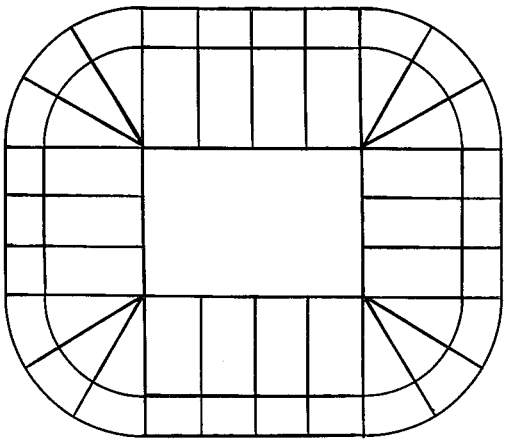
FIG. 6
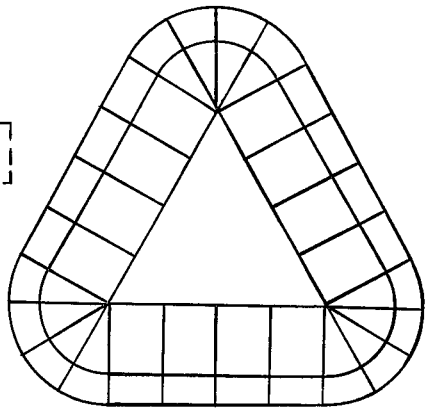
FIG. 7

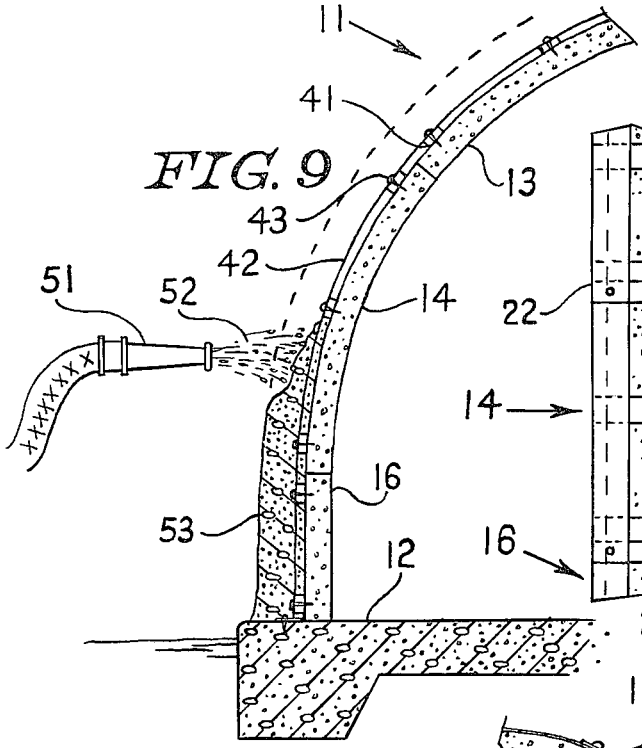
FIG. 9
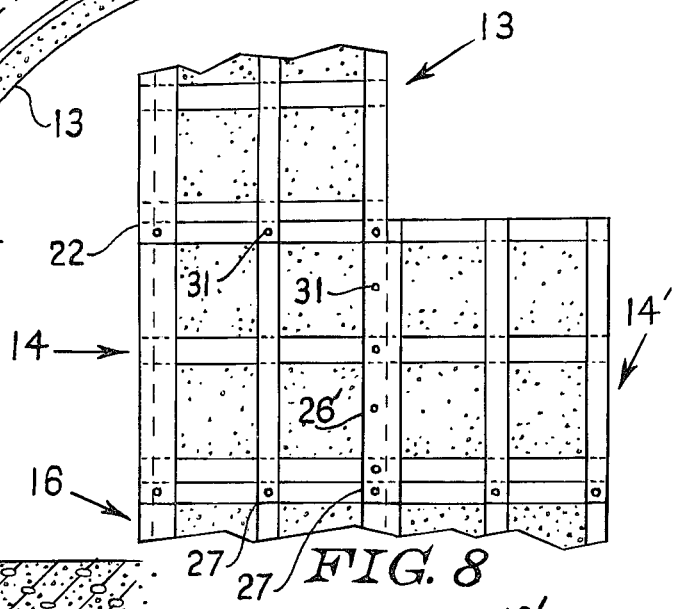
FIG. 8
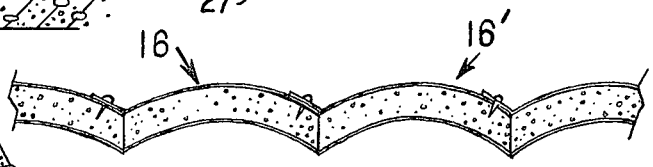
FIG. 8A
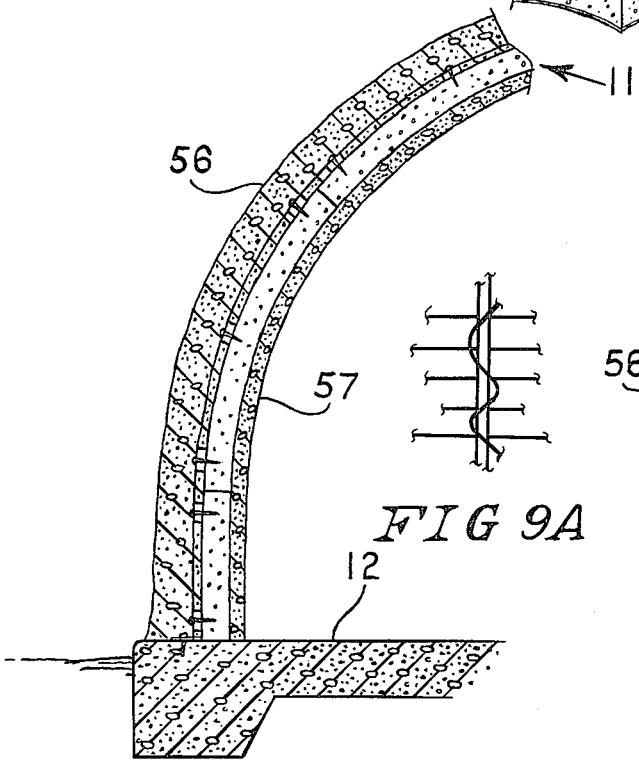
FIG. 10
FIG 9A
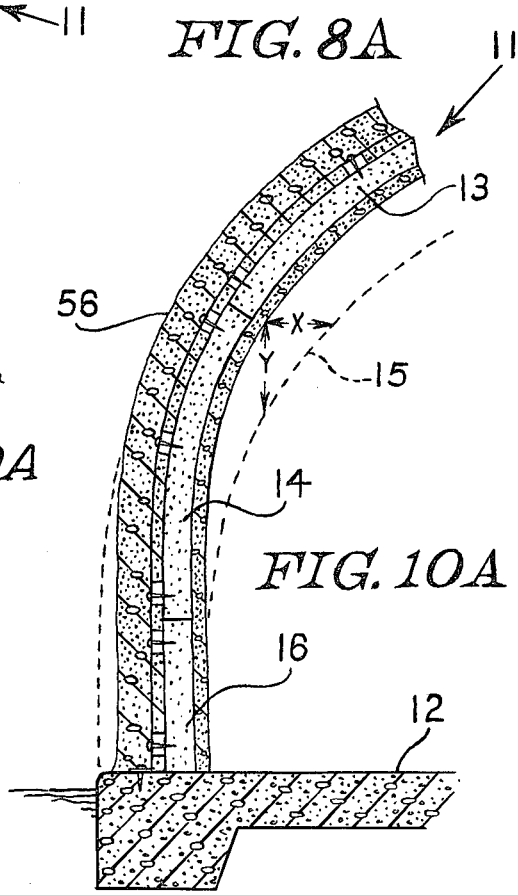
FIG. 10A

BUILDING SYSTEM AND METHOD

BACKGROUND OF INVENTION

Because of the high cost of constructing conventional wood frame buildings of small and medium size and steel and concrete buildings of large size, there have been many attempts to manufacture prefabricated structures. Commonly such structures include some type of wall modules which can be manufactured in a plane and joined together at construction sites. The advantage of mass producing buildings or building modules are well recognized; however, this type of construction has had only limited acceptance. An alternative to the foregoing has been the so-called balloon building wherein a rubber bag or the like is inflated upon a concrete slab to comprise an inner form upon which concrete is sprayed. After setting of the concrete the bag is deflated and removed. While this approach to building structures overcomes many prior art problems, there are numerous limitations which are disadvantageous.

The present invention provides a substantial departure from normal building construction in that prefabricated insulating panels are joined together to form a rigid structure upon which concrete or the like is applied to form a low cost structure having very good insulating properties.

SUMMARY OF INVENTION

The present invention employs preformed panels adapted to be joined together at a construction site to form the shell of a building or the like. These panels have an expanded plastic core with reinforcing strips on the front and back surfaces thereof. Preferably the panels are formed of expanded polystyrene having a substantial density, as of the order of 2 lbs. per cubic feet with thin metal strips bonded to the front and back surfaces at least along the edges thereof and extending in part from two edges on the front face of each panel. The strip extensions are adapted to overlap strips of adjacent panels for attaching the panels together. The panels employed in the building system hereof have a convex outer surface and are formed with a predetermined plurality of different sizes and configurations to fit together into a variety of building configurations. Upon the outer surface of each panel there is mounted a wire mesh in spaced relation to the outer surface and contiguous panels may be joined together by the use of sheet metal screws through overlapping metal reinforcing strips.

The building system hereof provides for the attachment together of a plurality of predetermined panels as described above to form a shell of a resultant building structure. The panels may be placed upon a concrete slab foundation, for example, and the bottom panels affixed thereto. The present invention employs panels that are curved in a single direction or two mutually perpendicular directions which in combination form convex exterior building surfaces to maximize the structural strength of the shell.

After erection of the shell, concrete or some substitute therefor is applied to the exterior thereof as by spraying or troweling thereon. The applied concrete envelopes the wire mesh on the exterior of the shell panels and there is thus produced a reinforced concrete building having insulating panels on the interior of the concrete walls. The inside of the building may be finished by the application of plaster, concrete, or the like covering the interior surfaces of the panels so that the panels remain in place as an insulating core or shell.

During construction of a building in accordance with the present invention the exterior wall and roof are maintained substantially unbroken and windows, for example, are affixed to the exterior of the shell with suitable framing and the shell later cut out to expose the window after the concrete has set. There may also be provided structural beams and appropriate temporary bracing thereof, as required by large structures formed in accordance with the present invention.

DESCRIPTION OF FIGURES

The present invention is illustrated as to particular preferred embodiments thereof in the accompanying drawings wherein:

FIG. 1 is a plan view of a simple spherical structure formed in accordance with the present invention;

FIG. 2 is a side elevational view of the structure of FIG. 1;

FIGS. 3, 4 and 5 are illustrations of insulating panels of different configurations employed in the building structure of FIGS. 1 and 2;

FIGS. 6 and 7 are plan views of alternative building configurations which may be formed in accordance with the present invention;

FIG. 8 is a partial view of a number of panels joined together in accordance with the present invention for use in the building system of the present invention;

FIG. 8A is a horizontal sectional view of a plurality of alternatively configured panels joined together;

FIG. 9 is a partial vertical sectional view of a wall of the building system of the present invention in process of applying concrete to the exterior thereof;

FIG. 9A is a partial schematic plan view showing the lacing together of the wire mesh of adjacent panels;

FIG. 10 is a partial vertical sectional view of a completed wall of a building in accordance with the present invention;

FIG. 10A is a partial vertical sectional view of an alternative wall configuration;

DESCRIPTION OF PREFERRED EMBODIMENTS

Figure 11:
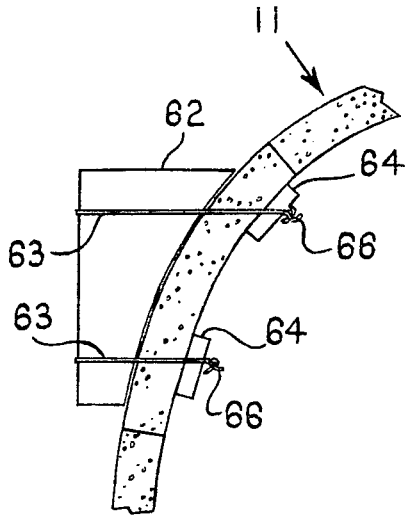
FIG. 11 is a partial sectional view illustrating the mounting of a window unit during construction of a building in accordance with the present invention.

Referring to FIGS. 1 and 2 of the drawings, there will be seen to be shown a simple semispherical building shell 11 in accordance with the present invention. This shell is shown to be placed upon a slab foundation 12 and tobe formed of a plurality of panels joined together, as noted below. In FIGS. 3 to 5 there are illustrated building panels as employed in the present invention and described in detail in our copending U.S. patent application Ser. No. 659,758 for "Composite Panel and Method of Manufacture". The panel 13 of FIG. 3 will be seen to have a triangular configuration in front elevation and the panels 14 and 16 have rectangular configurations in front elevation. Panel 16 is curved in one direction while panels 13 and 14 are curved in two directions so that upon assembly, as illustrated in FIG. 2, a plurality of panels substantially forms half a sphere. Each of the panels is provided as an expanded plastic core, such as expanded polystyrene, having thin reinforcing strips of metal, for example, bonded to front and back surfaces thereof. These strips are provided at least along the edges of the front and back surfaces and panel 13, for example, will be seen to have a strip 21 along the left edge of the front surface extending laterally outward from this edge. Each of the longitudinal strips on the front surface of panel 13 also extends beyond the lower edge of the panel to form tabs 22. The panel 14 similarly has a strip 26 on the front surface along the left edge, as viewed in FIG. 4, extending beyond the edge and also has the vertical strips extending below the bottom edge of the front face to form tabs 27. Panel 16 is formed in the same manner as panel 14 with a vertical strip 28 on the front face extending laterally outward of the left edge, as viewed in FIG. 5, and the vertical strips on the front face extending below the bottom edge of the panel to form tabs 29.

In FIGS. 1 and 2 there is illustrated a very simple semispherical shell for purposes of describing the present invention; however, it is noted that a wide variety of other configurations are also possible. In FIG. 6, for example, there is illustrated a shell configuration wherein the corners are spherical segments and straight walls are provided therebetween to form somewhat of a rectangular shape. For a shell of this configuration there are provided single radius panels which are curved only inwardly for the straight wall sections. In FIG. 7 there is illustrated a further simple shell configuration which is generally triangular. In this configuration the "corners" are formed as segments of a spherical surface with straight walls interconnecting them. In both FIGS. 6 and 7 the arrangement of panels is illustrated by the lines within the boundaries of the figures.

In FIG. 8 there is illustrated the attachment of panels together and it will be seen that a panel 13 is placed in contiguous relation to the upper edge of the panel 14 with the tabs 22 overlapping the horizontal reinforcing strip on the front face of the panel 14 at the top thereof. The panels 13 and 14 are secured together by driving sheet metal screws 31, for example, through the overlapping tabs 22 and the upper horizontal strip on panel 14. To the right of panel 14 in FIG. 8 there is illustrated another like panel 14' with reinforcing strip 26' of panel 14' overlapping the vertical reinforcing strip on the right side of panel 14. Sheet metal screws 31 or the like are driven through these overlapping strips to secure the panels 14 and 14' together. Successive panels are joined together in the manner described above by screwing or otherwise attaching overlapping strips on successive panels together.

In building structures of the type generally illustrated in FIGS. 6 and 7, there are included straight sections of wall as well as curved sections and, in order to maximize the structural rigidity of the straight sections, particularly for carrying an externally applied load such as wet concrete, the straight sections may be made up of a plurality of horizontally curved panels as indicated in FIG. 8A. This figure illustrates a horizontal section taken through a plurality of contiguous lower panels 16, 16', etc. of a straight section of wall. It will be seen in FIGS. 8A that the base panels 16, 16', etc. are curved in the illustrated horizontal plane and are connected together as by sheet metal screws through overlapping reinforcing strips as described above. The curved configuration of the base panels in FIG. 8A increases the loading capability of the generally straight wall thereof. It will be appreciated that upper panels placed on the curved panels 16, 16', etc. are similarly curved but do not have a tapered configuration, as indicated, for example, in FIG. 6.

In the formation of a shell 11, such as shown in FIGS. 1 and 2, the lower panels 16 are first mounted upon the slab 12 by bending the bottom tabs 29 outwardly and nailing or screwing the tabs to the slab. Panels 14 are then attached to the panel 16 atop same and panels 13 are then attached to panels 14 atop same. In this manner the shell is completed; however, it is noted that each of the panels have wire mesh on the outer surface thereof in spaced relation to such surface. As the structure is assembled from the panels, the wire mesh on adjacent panels is secured together as by lacing a wire 32 through the mesh along the joinder line, as shown in FIG. 9A, to thus form a substantially unbroken wire mesh cover on the outside of the shell. With the shell constructed as described above, the system hereof is then in condition for the application of concrete to the exterior of the shell, as further described below.

Reference is now made to FIG. 9 illustrating the application of wet or plastic concrete to a shell such as that shown in FIGS. 1 and 2. In this figure the mounting of the wire mesh is clearly illustrated and referring to panel 14, for example, it will be seen that spacer blocks 41 are provided on the outer surface of the panel on the reinforcing strips thereof with wire mesh 42 placed on the blocks and nails or screws 43 securing the mesh and blocks to the panel proper. Small washers may be placed under the heads of the screws to engage the mesh and hold it against the blocks as the screws are driven into the blocks and panel. With the shell in place, as described above and illustrated in part in FIG. 9, there is applied concrete or the like to the exterior thereof. Although concrete is a preferred coating applied to the shell, it will be appreciated that alternatives are possible such as an aggregate with some other type of binder or even a wet adobe in locations where concrete may not be readily available. In the following description the term "concrete" is taken to include substitutes therefor. Application of concrete is illustrated in FIG. 9 as being accomplished by a nozzle 51 through which plastic concrete is pumped to emerge as a spray 52. Concrete is applied to the shell from the bottom upwardly and is applied as a thick coating, i.e., a number of inches thick, to comprise a solid concrete wall upon the exterior of the shell. It will be seen that the concrete 53 envelopes the mesh 42 which then forms reinforcing bar or wire in the concrete. In accordance with general practice, the wire mesh is spaced outwardly of the shell a distance about one-third of the thickness of concrete coating to be applied to the shell. The shell 11 has sufficient structural rigidity to carry the weight of the concrete applied thereto. Thus the concrete is applied either by spraying or troweling on to a substantially rigid form comprising the shell and upon hardening or setting will form a concrete wall 56, as illustrated in FIG. 10. Preferably this concrete wall has a somewhat greater thickness at the bottom thereof upon the slab foundation 12 and, of course, means may be employed to tie the concrete wall to the foundation as, for example, by the provision of iron or steel bars embedded in the foundation and extending upwardly into the lower portion of the wall about the shell. The curved configuration of the shell provides maximum load-carrying capacity thereof so as to readily accommodate the application of a substantial amount of concrete to the exterior surface of the shell.

The interior of the structure is finished by the application of an interior coating 57 of plaster or the like. The interior surfaces of the panels are appropriately conditioned to receive the coating 57 as described, for example, in our above-noted copending U.S. patent application. Piping for the building is provided through the foundation slab 12 prior to building construction and internal electrical wiring may be readily accomplished by insetting conduit into the interior of the shell prior to plastering. Reinforcing strips are cut along conduit lines and the core depressed as by heat or routing so that the conduit fits into the shell. Additional metal tabs or short strips may then be attached over the cut strips to hold the conduit in place. Subsequent plastering or coating of the interior of the shell covers the conduits and strips to form a smooth inner surface. The finished walls entirely seal the panels therein to preclude any possible fire hazard and to achieve very good insulation. It is noted that various different interior coatings may be employed including concrete and, if necessary, wire mesh may be employed interiorly for the latter type of coating, although this is not normally necessary. The term "plaster" is herein taken to include substitutes therefor.

It will be appreciated that the provision of inwardly curving walls in the building system of the present invention is advantageous in maximizing the load-carrying capability of the shell 11; however, it will also be noted that such curvature causes some loss of head room adjacent the outer walls. This may be minimized in the manner illustrated in FIG. 10A. Referring to the figure, it will be seen that the base panel 16 is mounted on the slab 12 as previously described; however, the panel 14 atop the base panel 16 is swung outwardly about the bottom edge of the panel 14. The result of this arrangement is clearly illustrated in FIG. 10A, wherein the panel 14 is shown to be pivoted, as noted above, and the dashed line 15 indicates the original or unpivoted position of the panel. The distance $x$ indicates the amount that the top of the panel 14 is moved outwardly from unpivoted position and the distance $y$ indicates the resultant increase in head room interiorly of the shell because of this change in position of the panel 14. It will be seen that the distance $x$ and $y$ are about equal so that moving the top of the panel laterally outward 6 inches, for example, will increase the head room at the top of the panel by about the same amount. This is a rather significant improvement. The upper panel 13 remains attached to the panel 14 in the same manner as described above and it will be appreciated that, in order to complete the top of the structure, it is either necessary to elongate the total lengths of the panels 13 and 14 or to provide an alternative or cap structure at the center of the shell, as further described below. The configuration illustrated in FIG. 10A and briefly described above has a further advantage in providing the shell with a slightly outwardly curved configuration above the base panels 16 to further maximize the load-carrying capabilities of the shell. Application of concrete to the shell of FIG. 10A may be carried out as described above with the lower portion of the concrete being thicker than the upper portions, somewhat as illustrated by the dashed line to the left of FIG. 10A. In this manner the exterior wall of the resultant building structure provides no indication of the difference in shell arrangement from that of FIG. 10, for example. It will be appreciated that the amount by which the panels 14 are pivoted is exaggerated in FIG. 10A for the purpose of emphasizing the results thereof.

While the foregoing description sets forth the general concepts and steps in the building system of the present invention, there are certain details worthy of particular note. As stated above, the curved shell configuration maximizes the capability thereof to carry an exterior load of concrete when it is applied. In order to maintain maximum load-carrying capacity it is preferable that the shell not be pierced by openings prior to the application and hardening of the concrete. It is, however, normally necessary to provide windows and doors in a building and this is accomplished in the manner described below.

Figure 12:
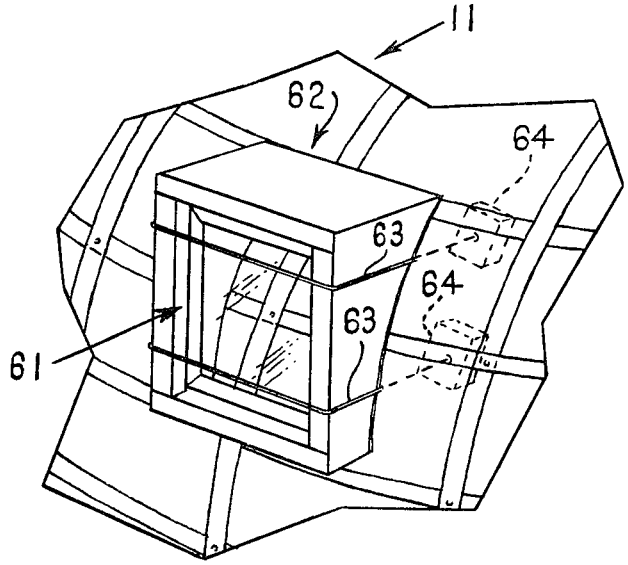
FIG. 12 is a partial perspective illustration of the window mounting of FIG. 11.
Figure 13:
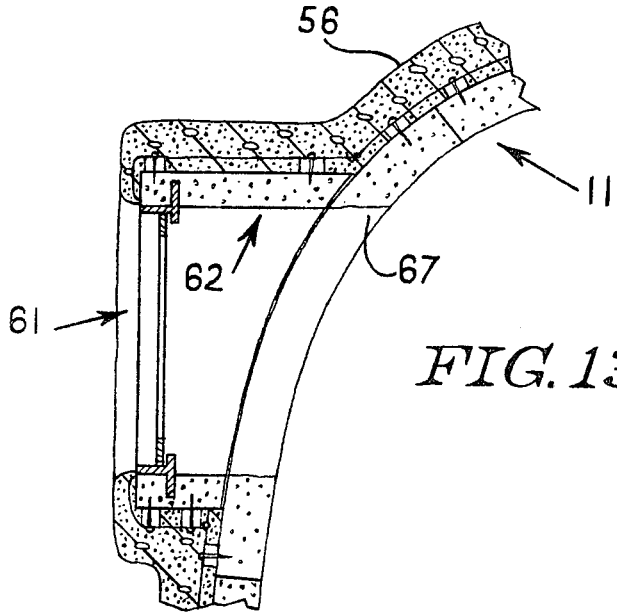
FIG. 13 is a vertical sectional view through a window unit in a building structure in accordance herewith prior to application of the internal plastic coating.

The provision of a window, for example, in a building structure in accordance with the present invention, may be accomplished in the manner illustrated in FIGS. 11 to 13 of the drawings. A conventional window and frame 61 is mounted exteriorly of the shell 11 by means of a frame 62 preferably formed of the same material as the shell and shaped to fit the exterior of the shell. This frame 62 mounts the window and integral frame 61, as shown, and generally comprises a box-like structure having the interior edges of the walls thereof curved to fit against the exterior of the shell. The frame 62, and window 61 carried thereby, is mounted in the appropriate position on the shell as by means of tie wires 63 placed about the frame and extending through the shell. The wires interiorly of the shell extend through a pad or washer or the like 64 and are there expanded as indicated at 66, so as to firmly hold the frame 62 on the exterior of the shell. The pads or washer 64 provide a sufficient area of contact with the shell to ensure that the wires are not pulled out of the shell when concrete is applied to the exterior of the building. If desired, wire mesh may also be placed on the frame 62 and if the frame is of any substantial size reinforcing strips may be bonded thereto during the formation of the frame. The frame 62 may in fact comprise a prefabricated part which need only be positioned on the exterior of the shell and wired thereto, with the window 61 being carried by the frame. During the application of concrete to the exterior of the shell the frame 62 is covered with concrete except for the window 61 therein. After the concrete has hardened to form the concrete wall 56, the shell is cut away from the inside thereof as indicated at 67 to expose the interior of the frame 62 and window 61, as illustrated in FIG. 13. This may be readily accomplished with a saber saw, for example, for the core and reinforcing strips are relatively easily cut with a saw or the like. When the interior plaster coating 57 is applied, it is extended into the interior of the frame 62 across the cut surfaces of the shell so as to provide a smooth interior surface covering the cut out surfaces of the shell. In this manner the structural integrity of the shell is not reduced prior to setting of the concrete so that the shell retains its full load-carrying capability during the time that this is required. It is noted that the portions of the wire covered by concrete remain in place and the remainder of the wire is cut off after the concrete sets with the wire ends being then sealed. It will, of course, be appreciated that at least one small opening is to be formed in the shell prior to application of the concrete so that it is possible for workmen to enter the shell for cutting the necessary openings to expose windows and doors. The above-described manner of forming window openings in the building is also suited to the formation of door openings.

Figure 14:
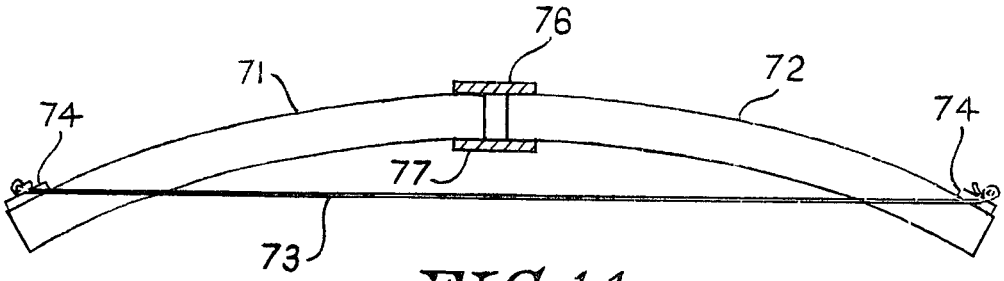
FIG. 14 is a vertical sectional view of the upper portion of the building structure in accordance herewith showing tensioning means for increasing the load-resistant characteristics of one roof structure in accordance herewith.

For some roof structures in accordance with the present invention, it is preferable to increase the load-carrying capacity and to provide means preventing any possible dislocation of shell panels as substantial amounts of wet concrete are applied to the roof. In FIG. 14 there is illustrated a sectional view of a pair of roof panels 71 and 72 which may be rectangular in plan view and are curved, as illustrated, in side elevation. These panels 71 and 72 are mounted upon and attached to wall panels beneath same in the manner previously described and are herein provided with tension wires 73 to prevent any possible outward movement of the lower edges of these roof panels with the application of an exterior load of concrete thereto. The tension wires 73 are shown to extend through the reinforcing strips at the lower corners of each of the panels 71 and 72. The tension wires 73 also extend through washers or the like 74 placed on the exterior of these washers. It will be seen that the application of concrete or other loading to the roof panels will tend to force the lower edges thereof outwardly because of the curvature of the panels; however, the tension wire or wires 73 take up this load and prevent such movement. The concrete applied to the exterior of the shell will entirely cover the washers 74 and the wire ends so that after the concrete has hardened, it is only necessary to cut off the wires in the interior of the shell and plaster over them so that there is no subsequent evidence that the wires were even employed. In the roof structure of FIG. 14 there is also shown the application of additional reinforcing strips 76 and 77 on the inner and outer sides of the joint between the roof panels 71 and 72 in order to further strengthen this joint. These strips 76 and 77 may be attached to the panels by sheet metal screws, for example, driven through the overlapping strips 76 and 77 and reinforcing strips on the panels. The type of roof structure illustrated in FIG. 14 is the type that may be employed, for example, in the building configuration of FIG. 6.

In FIGS. 15 to 18 there is illustrated one possible building configuration in accordance with the present invention. It will be seen that partial spherical surfaces and curved surfaces are employed in order to maximize the structural rigidity of the shell prior to application of the exterior concrete. With the building of FIGS. 15 to 18 having an interior area of 1,600 square feet, for example, the central roof 81 has a fairly substantial extent. Under such circumstances, it may be preferable to provide structural beams for supporting this roof structure. In this respect reference is made to FIG. 18 wherein there is shown a portion of an upper shell panel 82 with an L-shaped concrete or steel beam 83 disposed along the upper inner edge thereof. The beam 83 is formed as a continuous rectangle about the opening upon which the roof 81 is to be mounted and short vertical panels 84 are employed to box the opening for the roof with the roof 81 then resting upon these panels 84. Reinforcing bars 86 extend from the beam 83 into the concrete wall 56 to lock the beam into the concrete wall and roof. The manner of locking the beam to the concrete wall and roof may be varied; however, some type of attachment is to be provided so that the beam and wall become an integral unit in the finished structure. With this reinforcement, it is preferable to provide temporary bracing interiorly of the shell to hold the weight of the beam 83 and concrete to be applied on the exterior of the shell, as indicated at 87. This temporary bracing is removed after the exterior concrete is set. It will be appreciated that the application of concrete to the exterior of the shell and plaster to the interior of the shell entirely seals the panels and core material thereof and furthermore covers up any and all minor protuberances or the like which may exist on the shell surface because of the nature of same or the attachment of elements thereto.

Figure 15:
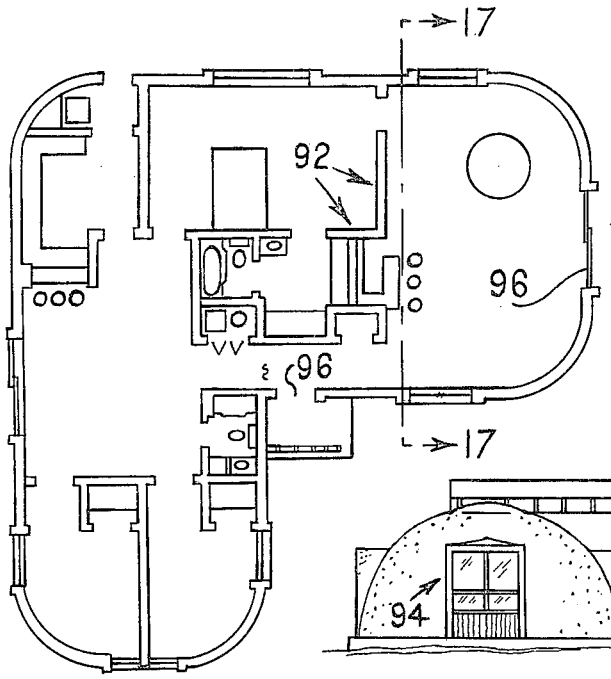
FIG. 15 is a floor plan view of a building formed in accordance with the present invention.
Figure 16:
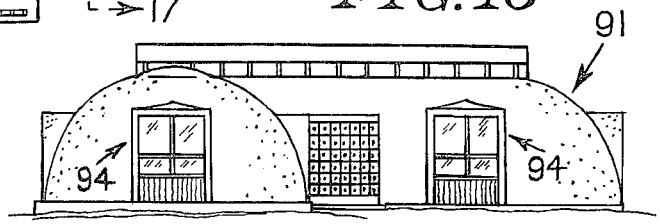
FIG. 16 is a side elevational view of the building of FIG. 15.
Figure 17:
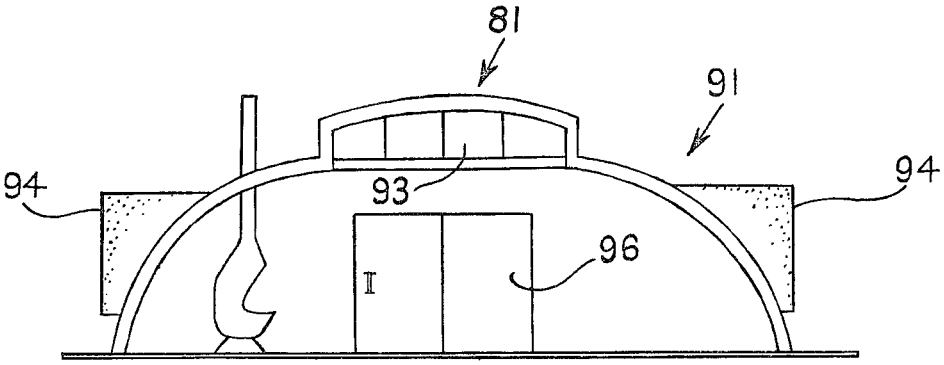
FIG. 17 is a vertical sectional view taken in the plane 17–17 in FIG. 15.
Figure 18:
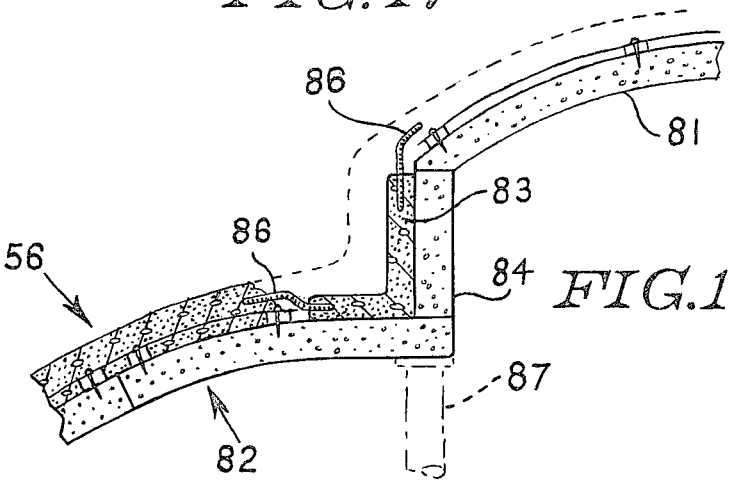
FIG. 18 is a partial sectional view illustrating placement of a stiffening beam as may be employed in the roof structure of the buildings of FIGS. 15 to 17.

The building 91 illustrated in FIGS. 15 to 17, for example, comprises a shell assembled in accordance with the present invention and operated upon to form a concrete wall on the exterior and a plaster coating on the interior. This building structure is adapted to have interior partitions and the like 92 formed therein in order to complete the building structure into a single family dwelling, for example. These interior partitions and the like may be conventionally constructed or alternatively may be prefabricated along the general lines of the present invention. Non-load bearing interior walls 92 may be formed of panels of the present invention having only plaster applied to opposite sides thereof and under these circumstances it is not necessary to apply the wire mesh to the panels. The preformed panels of the present invention are highly advantageous in building construction because of the ease and low cost of manufacture of the panels and the very good insulating properties of the panels which remain as a part of the final structure. It will be appreciated that, although only a few building configurations are illustrated, many others are possible. Additionally there are many architectural features which may be incorporated in the buildings constructed in accordance herewith such as, for example, cathedral windows 93 at the ends of the roof 81 of the building illustrated in FIGS. 15 to 17. It is recognized that the structure of the present building system does not have the square or angular look of many conventional buildings and, to the extent that this may be considered objectional, modifications which are not necessarily structural may be provided such as details about windows 94 and doors 96.

The present invention has been described above with respect to particular preferred embodiments of the invention, however, it will be apparent to those skilled in the art that modifications and variations are possible within the scope of the present invention. It is thus not intended to limit the present invention to the precise terms of description nor details of illustration.

What is claimed is:

1. A method of building fabrication comprising the steps of (a) attaching together a plurality of expanded plastic panels with reinforcing strips bonded thereto to form a building shell having integral walls and roof;

(b) said panels having wire mesh mounted on the outer faces thereof in offset relation thereto and lacing together the wire mesh of contiguous panels to form a wire mesh covering on said shell;

(c) applying wet concrete to the exterior of said shell on said mesh to form an integral concrete wall and roof of a building with the shell attached thereto, and (d) applying a plaster coating to the interior of said shell to completely seal said panels between concrete and plaster as an insulating core of the resultant building.

2. The method of claim 1 further defined by attaching said panels together by sheet metal screws driven through overlapping reinforcing strips on contiguous panels.

3. The method of claim 1 further defined by applying said wet concrete to the shell by spraying the concrete onto the shell from the bottom up with the concrete being applied thickest at the bottom of the shell and the concrete having a thickness of the order of a few inches to form upon hardening a rigid integral wall and roof of the building.

4. An improved building structure comprising a foundation;

a building shell mounted on said foundation and formed of a plurality of molded panels of expanded plastic having reinforcing strips on outer and inner faces thereof and attached together by overlapping reinforcing strips, said panels also having wire mesh mounted in offset relation to the outer faces thereof, said panels being disposed in adjacent contacting relationship and joined together to form a substantially continuous expanded plastic unitary shell with said wire mesh being joined together to form a substantially continuous mesh over said shell;

a concrete layer covering the outside of said shell with said wire mesh disposed in the concrete to form a single continuous rigid integral building wall and roof; and a plaster coating on the interior of said shell completely sealing said panels within the integral wall and roof of the building.

5. The building structure of claim 4 further defined by adjacent panels being joined together by screws extending through overlapping reinforcing strips and into the panels.

* * * * *